US010345080B2

(12) United States Patent
Brun

(10) Patent No.: US 10,345,080 B2
(45) Date of Patent: Jul. 9, 2019

(54) THERMAL CAMOUFLAGE DEVICE AND VEHICLE COMPRISING SUCH A DEVICE

(71) Applicant: NEXTER SYSTEMS, Roanne (FR)

(72) Inventor: Michel Brun, Bourges (FR)

(73) Assignee: NEXTER SYSTEMS, Roanne (FR)

( * ) Notice: Subject to any disclaimer, the term of this patent is extended or adjusted under 35 U.S.C. 154(b) by 222 days.

(21) Appl. No.: 14/924,175

(22) Filed: Oct. 27, 2015

(65) Prior Publication Data

US 2016/0123706 A1 May 5, 2016

(30) Foreign Application Priority Data

Oct. 30, 2014 (FR) ..... 14 02477

(51) Int. Cl.

| | |
|---|---|
| ***F41H 3/00*** | (2006.01) |
| ***F28F 11/06*** | (2006.01) |
| ***F28D 1/053*** | (2006.01) |
| ***F28F 13/18*** | (2006.01) |
| ***F28F 13/00*** | (2006.01) |

(52) U.S. Cl.

CPC ..... *F41H 3/00* (2013.01); *F28D 1/05325* (2013.01); *F28F 11/06* (2013.01); *F28F 13/00* (2013.01); *F28F 13/18* (2013.01); *F28F 2265/16* (2013.01); *F28F 2270/00* (2013.01)

(58) Field of Classification Search

CPC ..... F41H 3/00; F28F 2265/16; F28F 11/06; F28F 1/05308; F28F 13/00; F28F 13/18; F28D 1/05325; F28D 1/05358; F28D 1/0443

See application file for complete search history.

(56) References Cited

U.S. PATENT DOCUMENTS 4,738,309 A * 4/1988 Schilling ..... F28D 7/08 165/101
4,825,937 A * 5/1989 Kertzman ..... F16K 17/40 162/40

(Continued)

FOREIGN PATENT DOCUMENTS

| | | | |
|---|---|---|---|
| DE | 295 19 417 U1 | 6/1996 | |
| WO | 02/43445 A2 | 5/2002 | |
| WO | WO 0243445 A2 * | 5/2002 | ..... H05B 3/28 |

OTHER PUBLICATIONS

Jun. 16, 2015 Search Report issued in French Patent Application No. 1402477.

(Continued)

*Primary Examiner* — Jon T. Schermerhorn, Jr.
(74) *Attorney, Agent, or Firm* — Oliff PLC

(57) ABSTRACT

An infrared camouflage device and a vehicle including such a device which includes an array of parallel pipes carrying a heat-transfer fluid for changing the thermal signature of a vehicle. This device is characterized in that it includes an inlet manifold, an intermediary manifold, a first series of first pipes connecting the inlet manifold to the intermediary manifold, a second series of second pipes connecting the intermediary manifold to an outlet manifold, each first pipe being located in the vicinity of a second pipe so as to form, at the device, an alternation of first and second parallel pipes, the inlet manifold and the outlet manifold being in the vicinity of each other.

8 Claims, 5 Drawing Sheets

(56) References Cited

U.S. PATENT DOCUMENTS

| | | | | |
|---|---|---|---|---|
| 5,751,006 | A * | 5/1998 | Cooper | F41J 2/02 219/553 |
| 7,089,753 | B2 * | 8/2006 | Hoeks | F25C 3/02 62/235.1 |
| 2013/0312852 | A1 * | 11/2013 | Dickenscheid | F02M 59/462 137/535 |

OTHER PUBLICATIONS

Jun. 16, 2015 Written Opinion issued in French Patent Application No. 1402477.

* cited by examiner

THERMAL CAMOUFLAGE DEVICE AND VEHICLE COMPRISING SUCH A DEVICE

The technical field of the invention is that of thermal camouflage devices attached to the walls of a vehicle.

In order to change the thermal signature of a military vehicle for hiding it from infrared detectors, it is known by U.S. Pat. No. 5,751,006 to arrange, on the outside of a vehicle, in this particular case a ship, panels which can provide this masking function. Each panel is provided, in its upper part, with a first heat-transfer fluid manifold by which the fluid enters the panel. A second fluid manifold for retrieving the fluid of the first manifold is arranged in the part of the panel disposed at the bottom of the panel. Each manifold is connected to the other one by pipes parallel to each other, in which the heat-transfer fluid flows from the first manifold to the second manifold. The manifolds are connected to fluid cooling or warming means arranged on-board the vehicle, as well as to means for causing the fluid to circulate.

Thus, for example, the fluid will enter the first manifold at a temperature supposed to represent the thermal environment of the vehicle and will flow in the pipes, thereby masking the signature of the vehicle.

During the entire flow of the fluid in the device, it will exchange calories with the environment of the device. This results in a temperature gradient at the device, this gradient having the disadvantage of forming a singularity easily visible in the thermal image rendered by potential infrared detectors.

The invention aims to solve this problem of thermal discretion by providing a homogeneous masking.

According to a particular embodiment, the invention also allows to maintain an satisfactory operation in case of physical deterioration of the device.

The invention relates to an infrared camouflage device comprising an array of parallel pipes carrying a heat-transfer fluid for changing the thermal signature of a vehicle, the device being characterized in that it comprises an inlet manifold at which the heat-transfer fluid enters the device to be carried to an intermediary manifold by means of a first series of first pipes integral with the inlet manifold by their first end and with the intermediary manifold by their second end, a second series of second pipes carries the heat-transfer fluid from the intermediary manifold to an outlet manifold for discharging the fluid out of the device, the second pipes being integral with the intermediary manifold by their first end and with the outlet manifold by their second end, each first pipe being located in the vicinity of a second pipe so as to form, at the device, an alternation of first and second parallel pipes, the inlet manifold and the outlet manifold being in the vicinity of each other.

Advantageously, the distribution of the pipes and the manifolds is substantially in a same plane and allows to provide the device with a panel shape.

Advantageously, the pipes and the manifolds are embedded in a substrate homogenizing the thermal signature of the device.

Advantageously, the substrate has two walls between which the pipes are arranged, the first wall is intended to be oriented towards an outer face of the vehicle and is provided with a material improving the thermal insulation, a reflective film with a low thermal emissivity is provided on the face of this wall intended to be oriented towards the vehicle, the second wall is provided with a material improving the thermal conduction and the face of this second wall which is oriented to the outside of the vehicle is provided with a conductive metal film.

Advantageously, the material of the first wall improving the thermal insulation comprises polyurethane foam.

Advantageously, the material of the second wall improving the thermal conduction comprises an aluminium alloy.

According to a particular embodiment, each end of each pipe could have a calibrated valve so as to close the pipe in case the pipe breaks.

Advantageously, each valve could have a spring leaf located in a manifold and integral, by one of its edges, with the vicinity of the end of the pipe to be closed.

The invention also relates to a military vehicle comprising at least one thermal camouflage device according to the invention and a means for thermally controlling a heat-transfer fluid and for causing this fluid to circulate, this thermal control and circulation means being connected to the thermal camouflage device which is provided on at least one outer face of the vehicle.

The invention will become more apparent upon reading the following description, which description is made with reference to the appended drawings, drawings in which.

Figure 1:
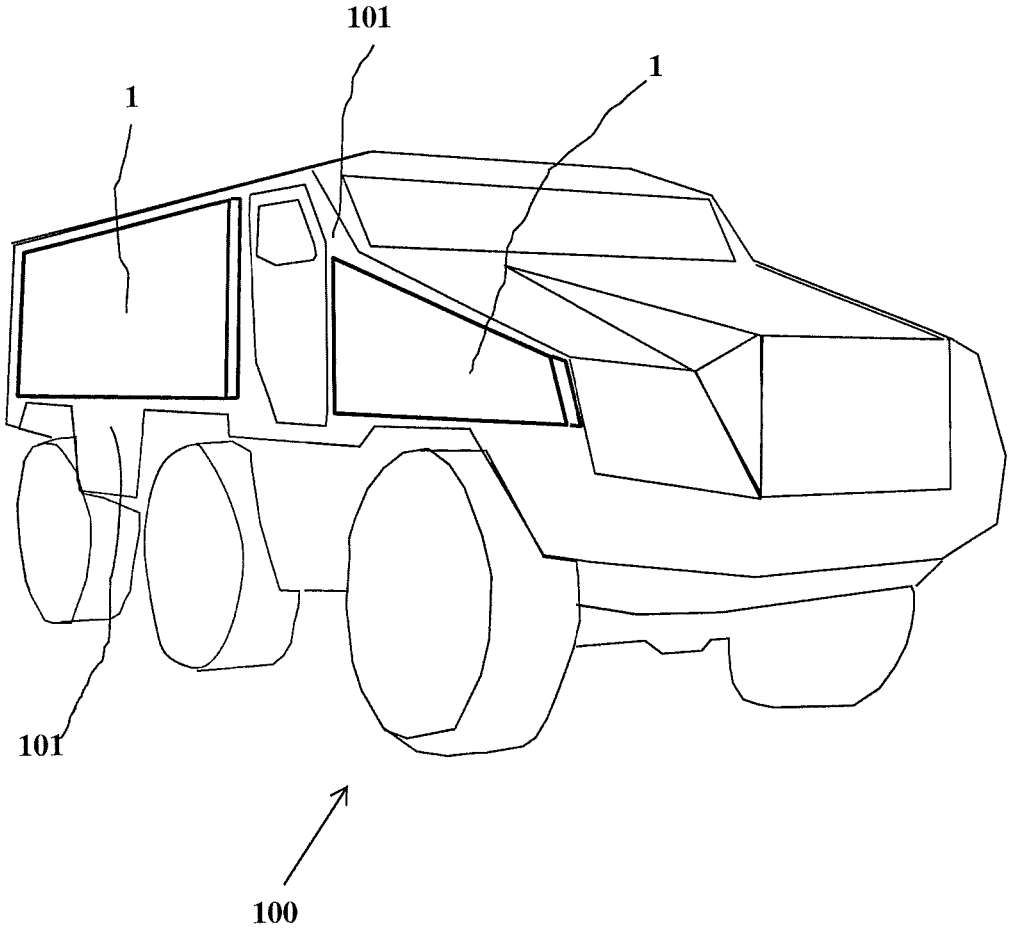
FIG. 1 shows a perspective schematic view of a vehicle comprising a device according to the invention.

According to FIG. 1, a military vehicle 100 is provided, on its outer vertical walls 101, with at least one camouflage device 1 according to the invention, intended to hide parts of the vehicle 100 which emit an infrared radiation contrasting with the thermal signature of the rest of the vehicle and the environment. In FIG. 1, it can be noted that the vehicle is provided, on a side wall, with two devices 1 as panels.

Figure 2:
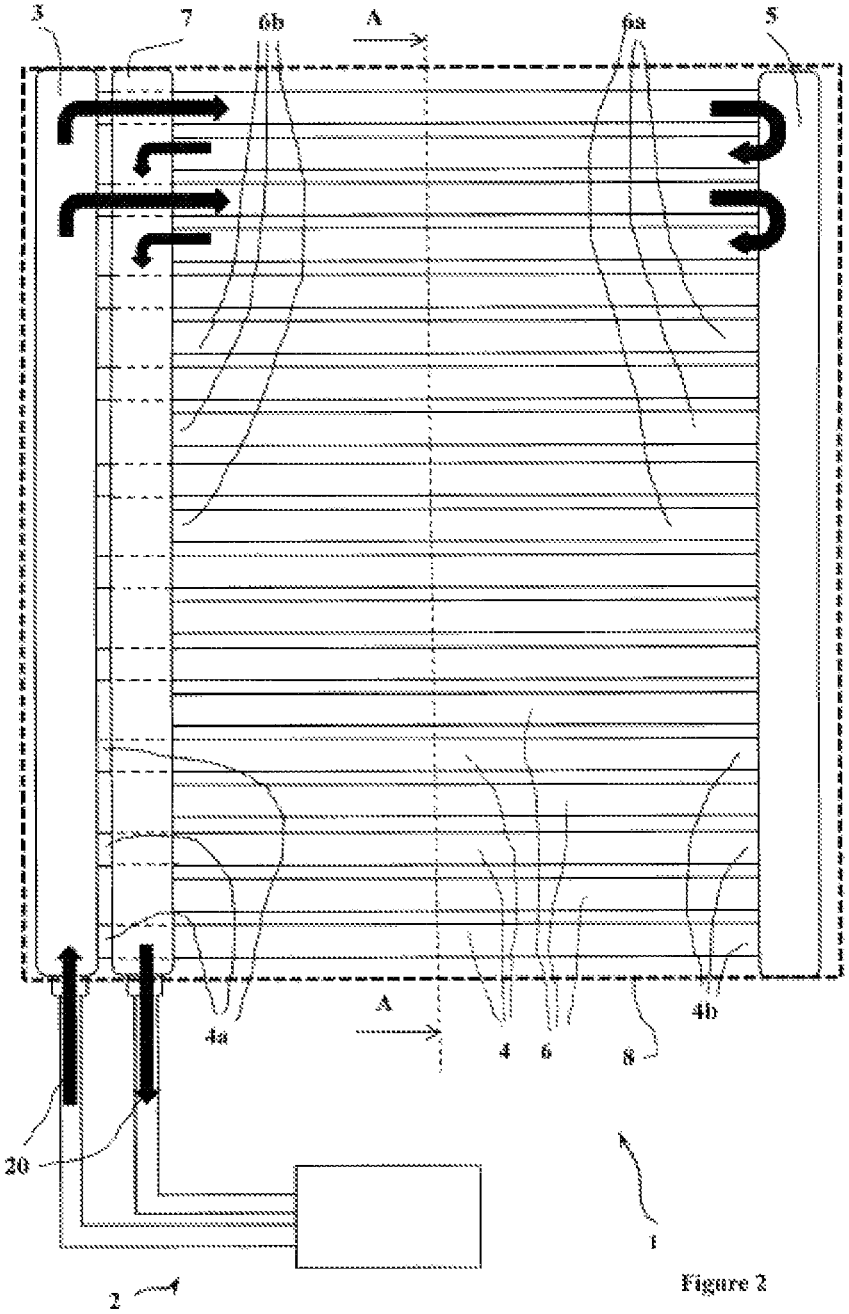
FIG. 2 shows a front view of a device according to a first embodiment of the invention.
Figure 3:
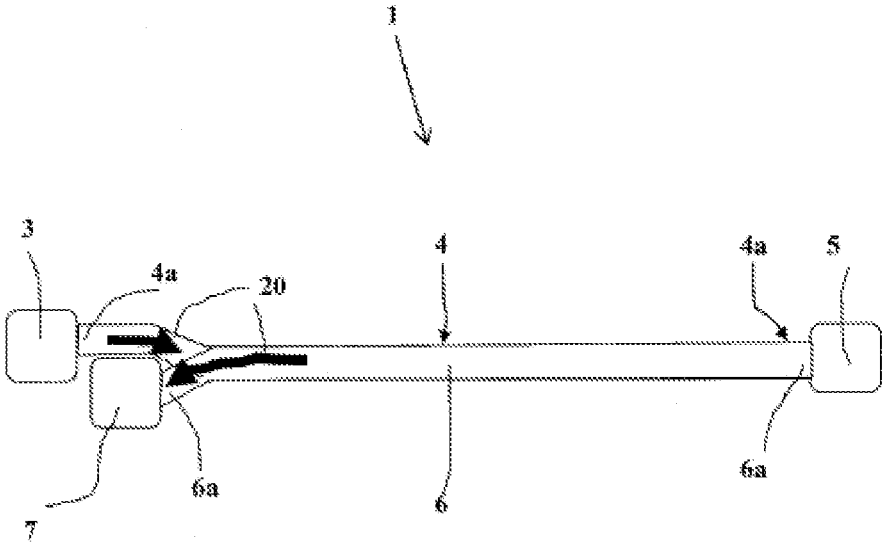
FIG. 3 shows a top view of a device according to the invention.

According to FIGS. 2 and 3, a camouflage device 1 according to a first embodiment is connected to a heat-transfer fluid carrying circuit 2 located on-board the vehicle. The circuit 2 has means (not shown) allowing the fluid 20 to circulate under pressure in the device 1, as well as means (not shown) for controlling the temperature of the fluid (air conditioning unit).

The heat-transfer fluid 20 could be a glycol and water mixture, for example. The circuit 2 leads to an inlet manifold 3 of the device 1. This manifold, like all those mentioned hereinafter, is a tubular structure, for example made of metal, or of plastic for more lightness.

This inlet manifold 3 is connected to a first series of first pipes 4 parallel to each other. The first pipes 4 of this first series are connected, by their first ends 4*a*, to the inlet manifold 3 so as to carry the heat-transfer fluid 20 to an intermediary manifold 5.

A second series of second pipes 6, which are parallel to the first pipes 4, is connected to the intermediary manifold 5 by the first ends 6*a* of the second pipes 6.

The second ends 6*b* of the second pipes 6 of the second series are connected to an outlet manifold 7 so as to carry the heat-transfer fluid 20 from the intermediary manifold 5 to the outlet manifold 7. The outlet manifold 7 is connected to the fluid carrying circuit 2.

The first pipes 4 are evenly distributed along the length of the manifolds 3 and 5.

A second pipe 6 of the second series is arranged between two first pipes 4 of the first series. The second pipes 6 are evenly distributed along the whole length of the manifolds.

The pipes 4 and 6 thus arranged form an alternation of first and second pipes 4 and 6.

A fluid flow will thus pass through each pipe 4 or 6 by flowing in the direction opposite to the flow in the adjacent pipe 4 or 6. The inlet manifold 3 is located in the vicinity of the outlet manifold 7.

During all its travel in the device, the heat-transfer fluid 20 will absorb or render, according to the desired effect, calories from/to the pipes and the manifolds of the device, these calories being then diffused to the outside environment.

In the following description, the case in which it is desired to increase the thermal signature by emitting calories from the device 1 is addressed. The emission of calories will create such a thermal gradient of the fluid 20 throughout its circulation in the device 1 that the temperature of the fluid 20 at the outlet of the device 1 will be substantially lower than that at the inlet of the device.

The same gradient phenomenon can be found at any point of the device 1 where any temperature measurement of the fluid 20, performed upstream another downstream measurement point (in the direction of flow of the fluid 20), will show a temperature difference, the upstream measurement point being hotter than the downstream measurement point.

Thus, a first end 4*a* of a first pipe 4 will be much hotter than a second end 6*b* of a second pipe 6 located next to it. If considering the device 1 as a whole, the distribution in alternation of the first 4 and second 6 pipes and the arrangement of the inlet 3 and outlet 7 manifolds in the vicinity of each other allow to homogeneously distribute the temperature gradient on the entire length of the device 1, thereby allowing not to have singularly hot parts and singularly cold parts.

Figure 4:
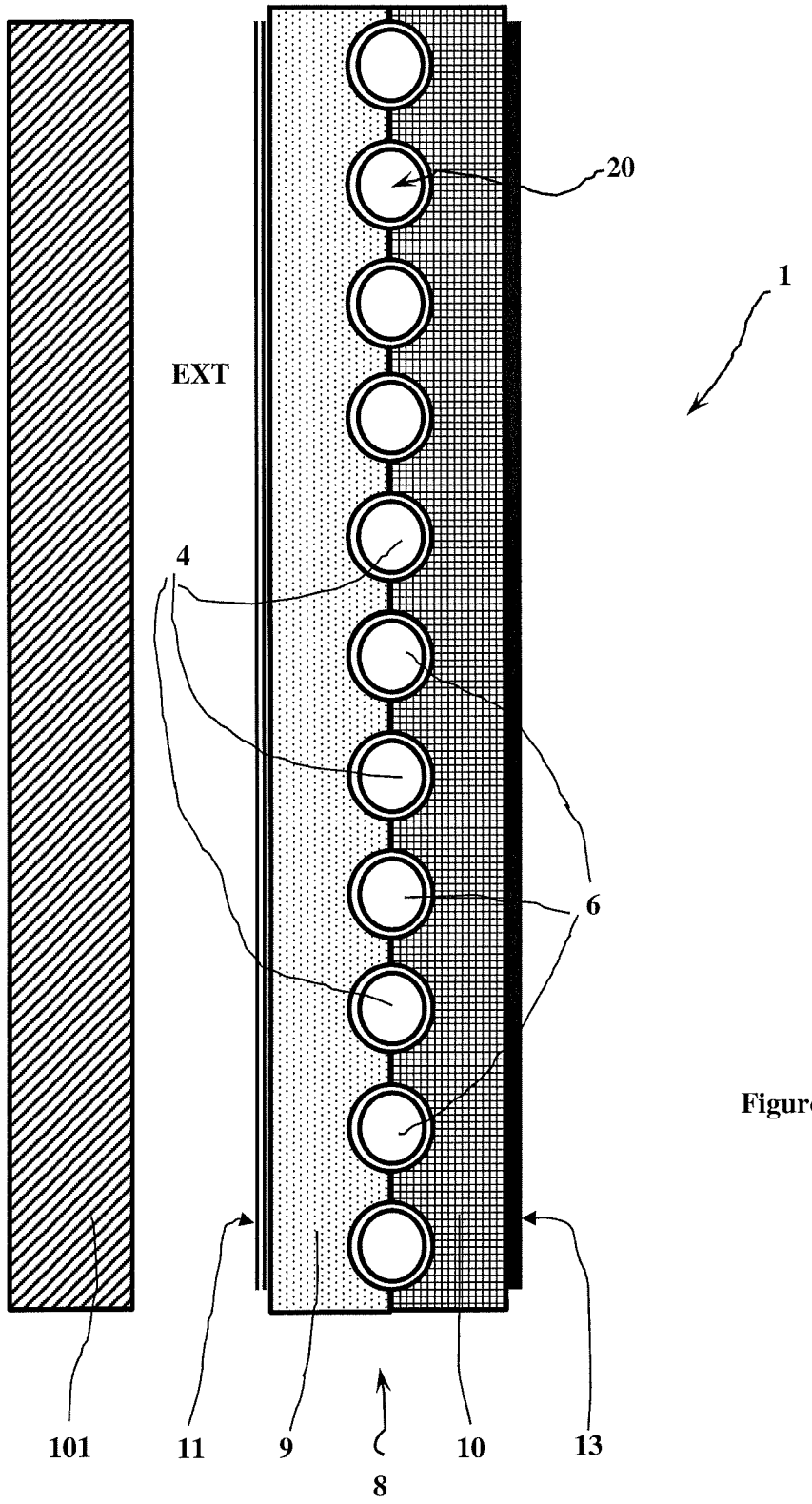
FIG. 4 shows a cross-sectional view of a device according to the invention, along the cutting plane the line AA of which is shown in FIG. 2.

According to FIG. 4 which shows a cross-sectional view along the plane AA visible in FIG. 2, the outside EXT of the partition wall 101 of the vehicle (vehicle visible in FIG. 1) is provided, at a distance from and parallel to this partition wall 101, with an infrared camouflage device 1 according to the invention. The device 1 has an alternation of first 4 and second 6 pipes embedded in the center of a multilayer substrate 8 providing a plane aspect to the device 1 and intended to improve the thermal homogeneity of the device 1.

The pipes 4 and 6 are located between two walls 9 and 10. The first wall 9 located towards the partition wall 101 of the vehicle is provided with an insulating material which could, for example, comprise a alveolated polyurethane foam. The face of this first wall 9 that is oriented towards the vehicle is provided with a film 11 with a low thermal emissivity comprising, for example, metalized polyethylene having a reflective surface.

The second wall 10 oriented towards the outside of the vehicle is provided with a material improving the thermal conduction, for example an aluminium alloy. The outer face 13 of this second wall is provided with a heat-conducting metal film 13 such as an aluminium alloy film. The first wall 9 and its film 11 are intended to prevent the losses of calories emitted towards the vehicle. The second wall 10 and its metal film 13 are intended to distribute the calories homogeneously in the device so as to provide a homogeneous thermal signature. The metal film 13 could, optionally, be coated with a paint.

In order to optimize the visual and thermal homogenization effects, the manifolds 3, 7 and 5 could also be incorporated in the substrate 8.

Figure 5:
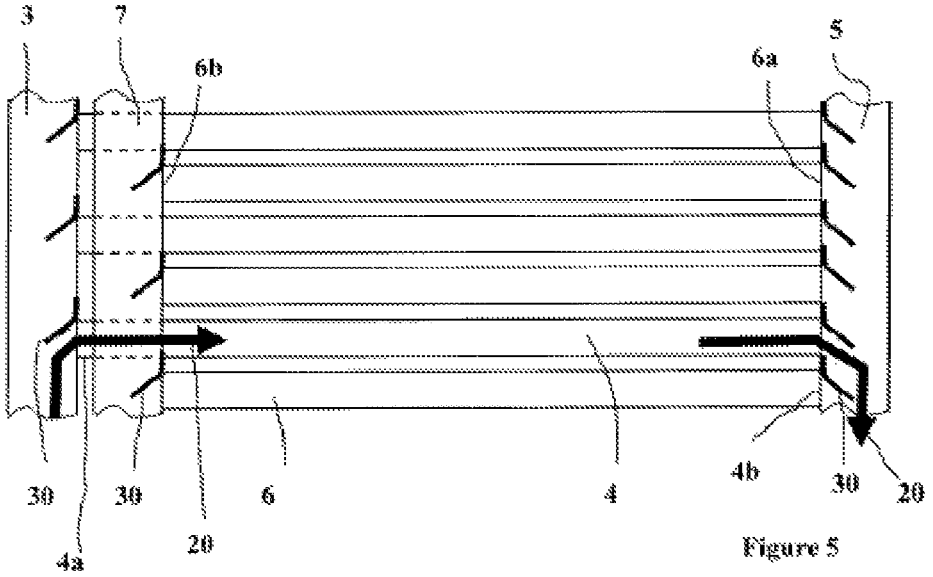
FIG. 5 shows a detailed schematic view of a device according to a second embodiment of the invention.

According to FIG. 5 which shows a device according to a second embodiment, each pipe 4 and 6 is provided with a valve 30 in the vicinity of each of its ends 4*a*, 4*b*, 6*a*, 6*b*. This valve 30 has a spring tab 30 integral, at one of its edges, with the interior of a manifold 3, 7 or 5.

In a rest position, the tab 30 is held at a distance from the opening of each pipe and thus allows the circulation of the fluid 20 between the pipes 4 and 6 and the manifolds 3, 7 and 5.

Figure 6:
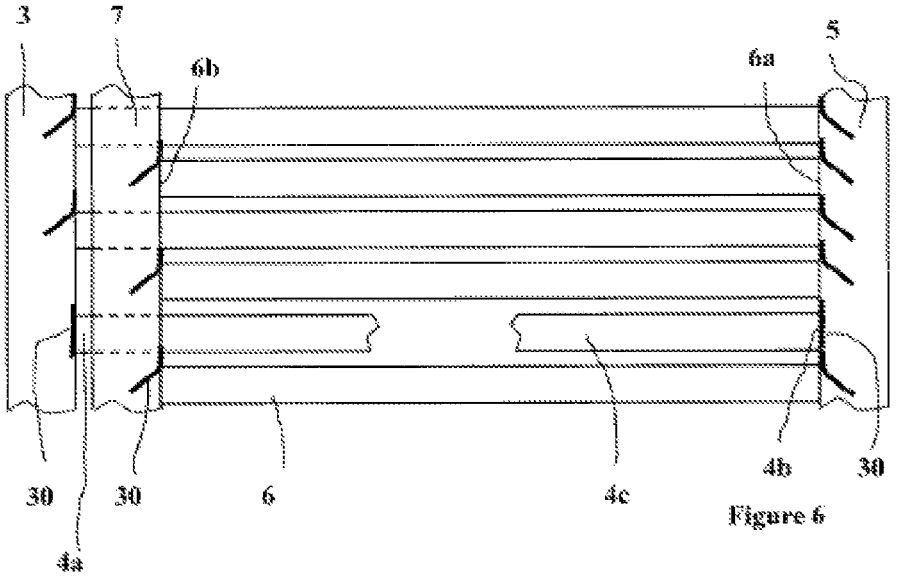
FIG. 6 shows a detailed schematic view of the device according to this second embodiment, when a pipe is broken.

The person skilled in the art will calibrate the spring tabs 30 such that they do not bend under the effect of the normal flow rate of the fluid 20 circulating in the device, but allowing the tabs to bend in such a manner that they close the end of a pipe 4*c* in case of accidental breaking as in FIG. 6.

This bending will be caused by the local and temporary flow rate difference at the ends of the broken pipe 4*c*. The bending will be maintained by the pressure difference between the interior of the device 1, where the fluid circulates under a pressure higher than the atmospheric pressure, and the outer atmospheric pressure.

Thus, in case of attack of the vehicle at the device, it could prevent the fluid from leaking and maintain its masking capacities.

It is obvious, for the person skilled in the art, that the valves 30 could have a different structure, it is sufficient that it allows a fluid to flow and stops it according to the conditions outlined above, for example a more sophisticated device could detect a pressure drop in a pipe by means, for example, of pressure detectors located in each pipe. The valves will then comprise automatic control valves disposed at each end of the pipes and could then be operated so as to stop the circulation of fluid in the damaged pipe.

The invention claimed is:

1. An infrared camouflage device comprising:

an array of parallel pipes carrying a heat-transfer fluid for changing the thermal signature of a vehicle;

an inlet manifold at which the heat transfer fluid enters the device;

an intermediary manifold; and an outlet manifold for discharging the fluid out of the device;

wherein the array of parallel pipes includes a plurality of first pipes and a plurality of second pipes, each of the first pipes having a first end integrally connected with the inlet manifold and a second end integrally connected with the intermediary manifold, each of the second pipes having a first end integrally connected with the intermediary manifold and a second end integrally connected with the outlet manifold;

wherein each of the connections between one of the pipe ends and the corresponding manifold defines an opening such that the heat-transfer fluid can flow from the inlet manifold to the intermediary manifold by means of the first pipes and from the intermediary manifold to the outlet manifold by means of the second pipes;

wherein each of the first pipes is located adjacent at least one of the second pipes and each of the second pipes is located adjacent at least one of the first pipes such that the array of parallel pipes comprises an alternation of the first and the second pipes, wherein the inlet manifold and the outlet manifold are adjacent to each other;

the infrared camouflage device further comprising a calibrated spring tab valve located at each of the openings, the calibrated spring tab valve comprising a tab and an edge, the edge is integrally connected with an interior of the manifold of the corresponding opening in a vicinity of the opening such that the tab is located in a position at a distance from the opening where the tab is capable of bending to close the opening; and wherein, in the event of a breakage in any of the pipes, the device is configured such that a flow rate and pressure difference caused by the breakage causes the calibrated spring tab valves corresponding to the ends of the broken pipes to close the openings corresponding to the ends of the broken pipes.

2. The infrared camouflage device according to claim 1, wherein the distribution of the pipes and the manifolds is substantially in a same plane and allows to provide the device with a panel shape.

3. The infrared camouflage device according to claim 1, wherein the pipes and the manifolds are embedded in a substrate homogenizing the thermal signature of the device.

4. The infrared camouflage device according to claim 3, wherein the substrate has two walls between which the pipes are arranged, the first wall is intended to be oriented towards an outer face of the vehicle and comprises a material which provides thermal insulation, a reflective film with a low thermal emissivity is provided on a face of the first wall that is intended to be oriented towards the vehicle, the second wall comprises a material which provides thermal conduction and a face of the second wall that is oriented to the outside of the vehicle is provided with a conductive metal film.

5. The infrared camouflage device according to claim 4, wherein the material of the first wall providing thermal insulation comprises polyurethane foam.

6. The infrared camouflage device according to claim 4, wherein the material of the second wall providing thermal conduction comprises an aluminum alloy.

7. The infrared camouflage device according to claim 1, wherein the tab of each calibrated spring tab valve corresponding to an upstream end of each of the pipes is oriented to be pushed closed in a direction of the flow, is stiff enough to resist closure during normal operation of the infrared camouflage device and is pliable enough to be pushed closed when the breakage in the corresponding pipe occurs.

8. A military vehicle comprising at least one thermal camouflage device according to claim 1, wherein the at least one thermal camouflage device is provided on at least one outer face of the vehicle.

* * * * *